United States Patent [19]

Kobayashi

[11] 4,410,171

[45] Oct. 18, 1983

[54] APPARATUS FOR AUTOMATICALLY ALIGNING A WORKPIECE ALONG THE LINE OF FEED

[75] Inventor: Kensaku Kobayashi, Chiryu, Japan

[73] Assignee: Aisin Seiki Kabushiki Kaisha, Kariya, Japan

[21] Appl. No.: 350,511

[22] Filed: Feb. 19, 1982

[30] Foreign Application Priority Data

Feb. 26, 1981 [JP] Japan ..... 56-028151

[51] Int. Cl.[3] ..... B65H 7/10

[52] U.S. Cl. ..... 271/227; 271/252; 226/20; 112/121.15

[58] Field of Search ..... 271/227, 228, 252; 226/3, 19, 20; 112/121.12, 121.15

[56] References Cited

U.S. PATENT DOCUMENTS 1,941,248 12/1933 Cottrell ..... 271/228

4,371,159 2/1983 Doyen ..... 271/228

*Primary Examiner*—Richard A. Schacher

*Attorney, Agent, or Firm*—Sughrue, Mion, Zinn, Macpeak and Seas

[57] ABSTRACT

An apparatus for automatically aligning a workpiece along the line of feed is comprised of two pivotally interconnected arms extending transversely to the line of feed with each arm having a workpiece gripping element at one end thereof adapted to engage the workpiece adjacent an edge thereof. A solenoid is operatively connected to the opposite end of one of said arms for pivoting said one of said arms on the frame of a sewing machine to move the workpiece gripping element thereon into and out of engagement with said workpiece along a substantially vertical path. A servo motor operated eccentric is connected to the opposite end of the other of said arms for moving the workpiece gripping element thereon transverse to the edge of the workpiece along a substantially semi-oval path in opposite directions to periodically engage and shift said workpiece transversely to the line of feed. A photoelectric sensor is also provided for sensing the location of an edge of the workpiece and providing a signal for controlling said solenoid and said servo motor operated eccentric means.

3 Claims, 5 Drawing Figures

APPARATUS FOR AUTOMATICALLY ALIGNING A WORKPIECE ALONG THE LINE OF FEED

BACKGROUND OF THE INVENTION

The present invention is directed to an apparatus for automatically aligning a workpiece along the line of feed and more specifically to servo operated feed means movable transversely to the line of feed for shifting a workpiece transversely to the line of feed in response to a signal provided by photosensitive workpiece edge sensing means.

In conventional apparatus for aligning a workpiece along the line of feed, roller means are generally used to shift the edge of the workpiece relative to the line of feed. However, such roller means are generally large and cumbersome and cannot be located in the vicinity of the stitch forming mechanism where the need for correct alignment is greatest. Furthermore, such rollers generally tend to accumulate waste thread and lint which could interfere with the accuracy of the alignment.

SUMMARY OF THE INVENTION

The present invention provides a new and improved apparatus for automatically aligning a workpiece along the line of feed which overcomes the aforementioned drawbacks.

The present invention provides a new and improved apparatus for automatically aligning a workpiece along the line of feed which is relatively small and compact at the point of engagement with the workpiece so that the apparatus can be placed in close proximity to the stitch forming mechanism without undue interference.

The present invention provides a new and improved apparatus for automatically aligning a workpiece along the line of feed comprised of two pivotally interconnected arms extending transversely to the line of feed and each having a workpiece gripping element at one end thereof adapted to engage the workpiece adjacent an edge thereof, solenoid means operatively connected to the opposite end of one of said arms for pivoting said one of said arms on the frame of a sewing machine to move the workpiece gripping element thereon into and out of engagement with said workpiece along a substantially vertical path, servo motor operated eccentric means connected to the opposite end of the other of said arms for moving the workpiece gripping element thereon transverse to the edge of the workpiece along a substantially semi-oval path in opposite directions to periodically engage and shift said workpiece transversely to the line of feed and photoelectric sensing means for sensing the location of an edge of the workpiece and providing a signal for controlling said solenoid means and said servo motor operated eccentric means.

The foregoing and other objects features and advantages of the invention will be apparent from the following more particular description of a preferred embodiment of the invention as illustrated in the accompanying drawings.

DETAILED DESCRIPTION OF THE INVENTION

Figure 1:
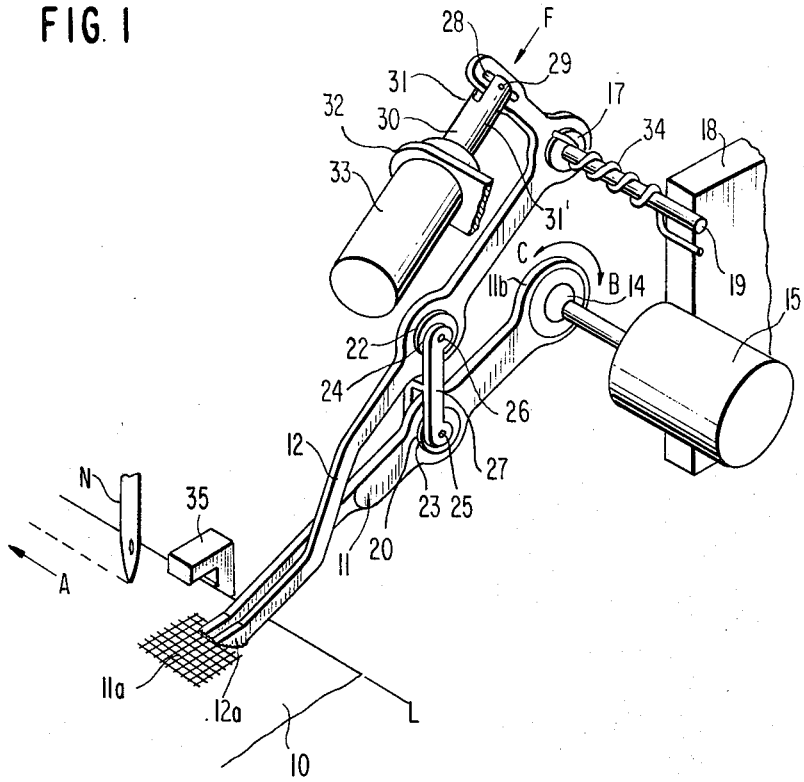
FIG. 1 is a perspective view of the apparatus according to the present invention.
Figure 2:
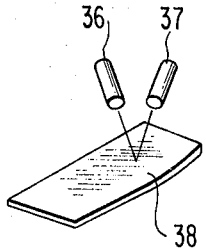
FIG. 2 is a perspective view of a portion of the photoelectric sensor.

The apparatus as shown in FIG. 1 is designed primarily for use with a sewing machine although it is conceivable that the apparatus could be used in other applications where it is desirable to align a workpiece relative to the line of feed of the workpiece. Since the sewing machine is conventional the only portion thereof which has been illustrated in FIG. 1 is the needle. The usual feed mechanism for the sewing machine feeds the fabric workpiece 10 in the direction of the arrow A along the line of feed L. The edge of the fabric workpiece 10 passes through a photoelectric sensing device 35 which is provided with a transmitter 36, a receiver 37 and a reflector 38 arranged in the manner shown in FIG. 2. Thus, as the edge of the fabric workpiece 10 shifts relative to the point where the light from the transmitter 36 is reflected from the reflector 38 to the receiver 37, the receiver 37 will either receive or not receive the light beam. The photoelectric sensing device 35 provides a suitable electrical output signal indicative of the position of the edge of the fabric workpiece relative to the line of feed. Such photoelectric sensing devices are conventional in the art and a further detailed description of the construction and circuitry thereof is not deemed necessary.

The apparatus for automatically aligning the edge of the workpiece 10 relative to the line of feed L includes first and second arms 11 and 12 which extend transversely relative to the line of feed L above the workpiece 10. Knurled fabric gripping elements **11*a* and 12*a* are connected to the ends of the arms 11 and 12** respectively.

The opposite end of the arm 11 is provided with a cylindrical sleeve **11*b*. An eccentric cam 14 is located within the cylindrical sleeve 11*b* and operatively connected thereto by means of an annular bearing 13. The eccentric cam 14 is mounted on the end of the shaft 16 of a servo motor 15 which is secured to the stationary framework 18 of the apparatus. Rotation of the eccentric cam 14 cooperates with the movement of the second arm 12, in a manner described hereinafter, to move the fabric gripping element 11*a* of the arm 11 through a semi-oval path shown by dot-dash lines in FIGS. 4 and 5** which extends transverse to the line of feed L.

The second arm 12 is pivotally mounted through a bearing 17 on a shaft 19 secured to the fixed framework 18 of the apparatus. The arm 12 is substantially L-shaped and the end thereof opposite the fabric gripping element **12*a* is provided with an elongated slot 28. A solenoid 33 is fixedly mounted in a portion 32 of the frame 18 of the apparatus and is provided with a reciprocating plunger 30. The outer end of the plunger 30 is split to define two spaced apart projecting portions 31 and 31'. The end of the arm 12 having the slot 28 therein is located between the projecting portions 31 and 31' and a pin 29 carried thereby extends through the slot 28. Upon energization of the solenoid 33, the plunger 30** will move in the direction of the arrow F to pivot the arm 12 in a counterclockwise direction about the bearing 17 on the shaft 19. A spring 34 is provided for biasing the arm 12 for rotation in the clockwise direction about the bearing 17 upon deenergization of the solenoid 33.

The two arms 11 and 12 are pivotally interconnected at approximately their midpoints by means of a link 27. A bearing 23 is mounted in a hole 20 in the arm 11 and a bearing 24 is mounted in a hole 22 in the arm 12. The connecting link 27 is connected to the bearings 23 and 24 by means of pivot pins 25 and 26, respectively.

Figure 3:
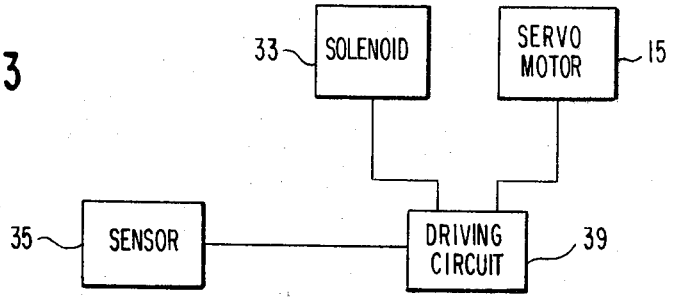
FIG. 3 is a schematic circuit diagram for the apparatus shown in FIG. 1.

As best seen in FIG. 3 the photoelectric sensor 35 is electrically connected to a driving circuit 39 with in turn controls the solenoid 33 and the servo motor 15. The driving circuit 39 is so designed that the edge of the workpiece 10 may be moved transversely relative to the line of feed L in order to keep the edge of the fabric 10 in alignment with the line of feed. If the light from the transmitter 36 is able to be reflected into the receiver 37, the servo motor 15 will be rotated in the direction of the arrow B. Should the light beam be interrupted by the edge of the fabric, the servo motor 15 will be operated in the reverse direction to rotate in the direction of the arrow C. The driving circuit 39 is also so designed that the solenoid 33 is excited intermittently so as to move the fabric gripping element 11*a* of the arm 11 in a substantially vertical direction into and out of engagement with the fabric workpiece 10. The energization of the solenoid 33 and the driving motor 15 are so timed that the fabric gripping elements 11*a* and 12*a* act alternately on the workpiece. Thus, while the fabric gripping element 11*a* of the first finger 11 is shifting the fabric workpiece 10 relative to the line of feed L, the fabric gripping element 12*a* of the second arm 12 is located above the workpiece. On the other hand, while the fabric gripping element 11*a* of the first arm 11 is located above the workpiece 10 the workpiece is lightly engaged by the fabric gripping element 12*a* of the arm 12 to hold the workpiece 10 against further transverse shifting relative to the line of feed L while the fabric gripping element 11*a* is being repositioned for a subsequent feeding operation.

Figure 4:
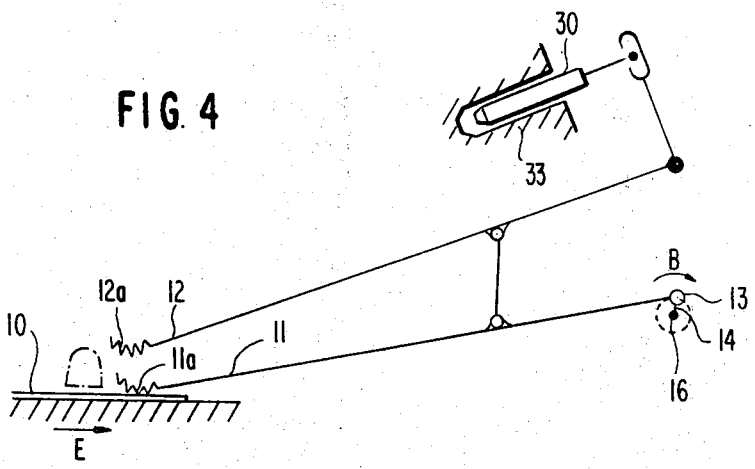
FIG. 4 is a schematic side elevation view showing the elements of the apparatus in one position during operation of the apparatus.
Figure 5:
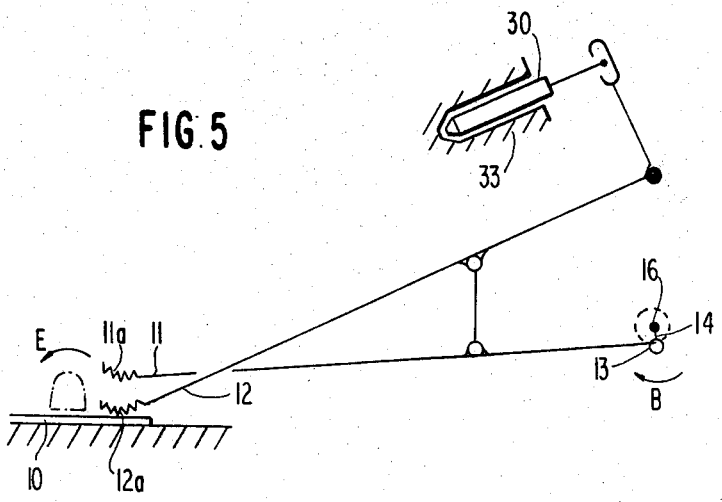
FIG. 5 is a schematic side elevation view of the same elements of the apparatus in another position during operation of the apparatus.

As mentioned previously the semi-oval path which the fabric gripping element 11*a* follows is shown by dot-dash lines in FIGS. 4 and 5. As the eccentric 14 rotates in the direction of the arrow B from the position shown in FIG. 4 to the position shown in FIG. 5, the fabric gripping element 11*a* will be lifted from the fabric workpiece 10 and moved in the direction of the arrow E as shown in FIG. 5. As the eccentric 14 continues to rotate back to the position shown in FIG. 4 in the direction of the arrow B, the fabric engaging element 11*a* will engage the fabric and shift the fabric to the right in the direction of the arrow E as shown in FIG. 4. Upon rotation of the eccentric 14 in the opposite direction a similar path would be followed by the fabric gripping element 11*a* but the shifting of the fabric would be in a direction opposite to the direction of the arrow E in FIG. 4. While the invention has been particularly shown and described with reference to the preferred embodiment thereof, it will be understood by those in the art that various changes in form and details made be made therein without departing from the spirit and scope of the invention.

I claim:

1. An apparatus for automatically aligning a workpiece along the line of feed comprising two pivotally interconnected arms extending transversely to the line of feed, each of said arms having a workpiece gripping element at one end thereof adapted to engage the workpiece adjacent an edge thereof, solenoid means operatively connected to the opposite end of one of said arms for pivoting said one of said arms on a stationary frame to move the workpiece gripping element thereon into and out of engagement with said workpiece along a substantially vertical path, servo motor operated eccentric means connected to the opposite end of the other of said arms for moving the workpiece gripping element thereon transverse to the edge of the workpiece along a substantially semi-oval path in opposite directions to peridically engage and shift said workpiece transversely to the line of feed and photoelectric sensing means for sensing the location of an edge of the workpiece and providing a signal for controlling said solenoid means and said servo motor operated eccentric means.

2. An apparatus as set forth in claim 1 further comprising link means pivotally interconnected at opposite ends to each of said arms adjacent the approximate midpoints thereof.

3. An apparatus as set forth in claim 1 further comprising spring means for biasing said one of said arms in the opposite direction upon deenergization of said solenoid means.

* * * * *